United States Patent [19]

Hess et al.

[11] 4,089,279

[45] May 16, 1978

[54] APPARATUS FOR THE MANUFACTURE OF REINFORCED PANTIES

[75] Inventors: Otto Hess, Heilbronn-Klingenberg; Heinz Dokter, Nordheim; Werner Scherzinger, Bisingen, all of Germany

[73] Assignee: Firma Mayer & Cie., GmbH. & Co., Tailfingen, Germany

[21] Appl. No.: 767,493

[22] Filed: Feb. 10, 1977

[51] Int. Cl.[2] ..... D05B 21/00

[52] U.S. Cl. ..... 112/121.12; 112/203

[58] Field of Search ..... 112/121.12, 121.11, 112/121.15, 121.14, 10, 121.29, 203

[56] References Cited

U.S. PATENT DOCUMENTS

| | | | |
|---|---|---|---|
| 2,546,831 | 3/1951 | Newell | 112/121.11 |
| 2,757,624 | 8/1956 | MacIsaac, Jr. | 112/121.11 |
| 3,407,759 | 10/1968 | Scholl et al. | 112/121.12 |
| 3,428,005 | 2/1969 | Scholl | 112/121.15 |
| 3,670,675 | 6/1972 | Rovin et al. | 112/121.12 |
| 3,773,002 | 11/1973 | Burton | 112/121.12 |

*Primary Examiner*—H. Hampton Hunter

[57] ABSTRACT

An improved technique for automatically producing a reinforced, peripherally contoured fabric blank adapted to be folded over and sewn to form a finished panty is described. A plurality of fabric segments to the central portion of which an underlying reinforcing strip is sewn is advanced along a conveyor and into a first one of a plurality of work stations distributed around a turret that is rotatably carried on a fixed support. A plurality of magnetically-actuable fabric holders are rotatably supported on the outer ends of corresponding spider arms that extend toward the work stations from the turret. Each holder has a contoured periphery corresponding to that of the panty blank, and after receiving the fabric segment from the conveyor indexes it successively into a plurality of second work stations each equipped with a contour sewing machine. During each such indexing movement, the holder is rotated about its axis to present, to each sewing machine, a different portion of its periphery, and each corresponding sewing machine is adapted to cut off the excess of the fabric segment projecting beyond the then-presented periphery of the holder and to sew an edge seam on the segment along such peripheral portion of the holder. After all four sides of the segment have been cut away and seamed, the resulting blank can be folded over parallel to the edges of the reinforcing strip and provided with closing seams to complete the panty.

13 Claims, 15 Drawing Figures

FIG. 2
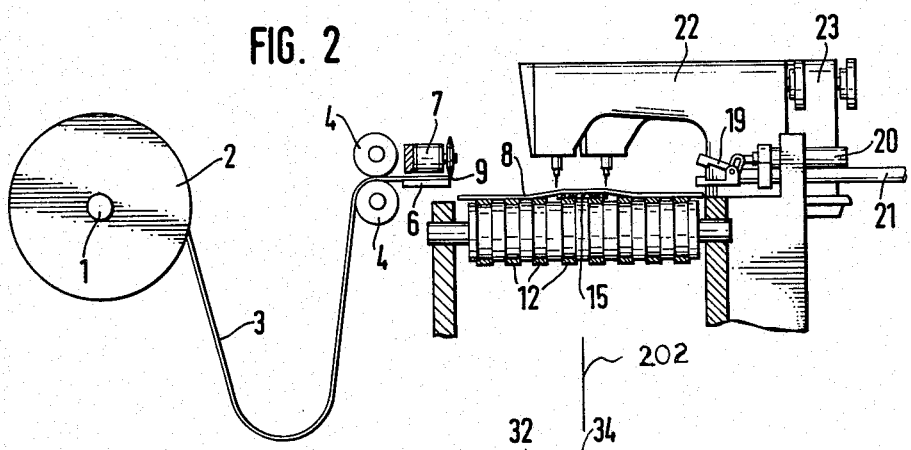
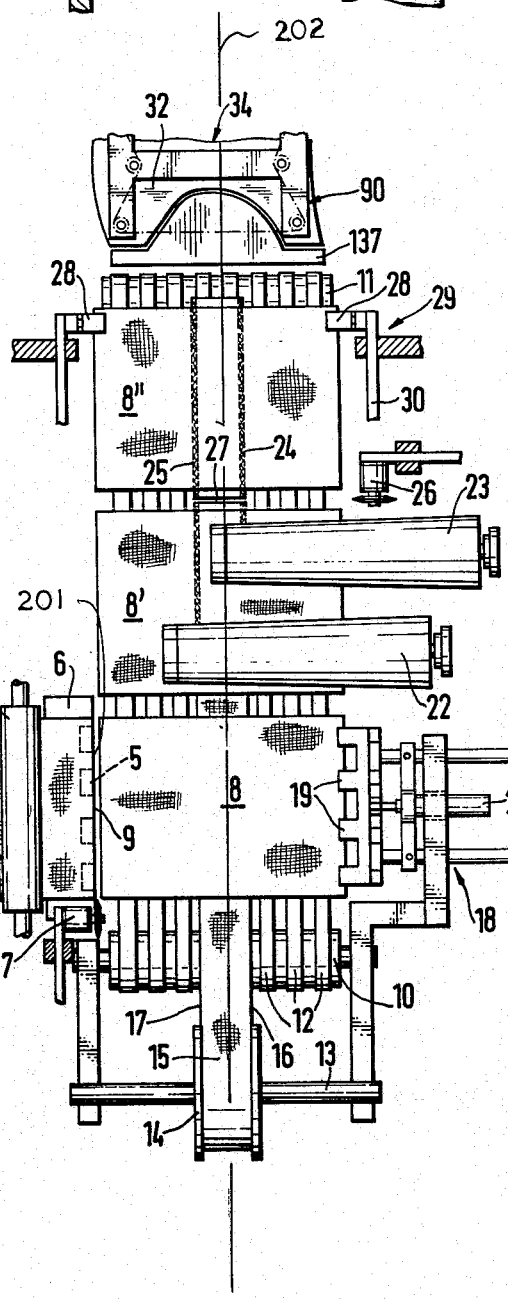
FIG. 1

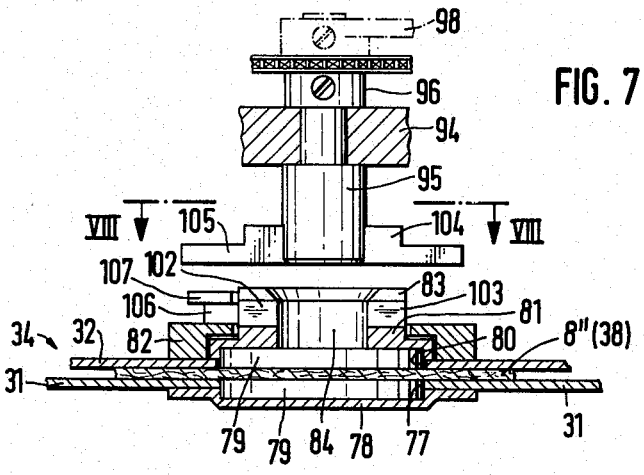
FIG. 7
FIG. 8
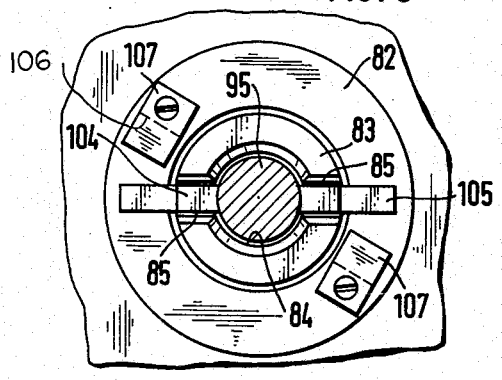
FIG. 9
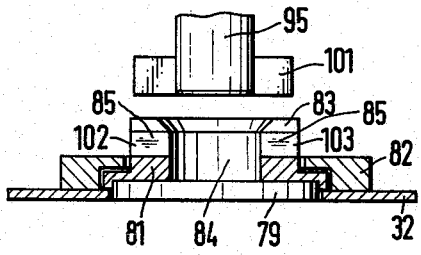
FIG. 5
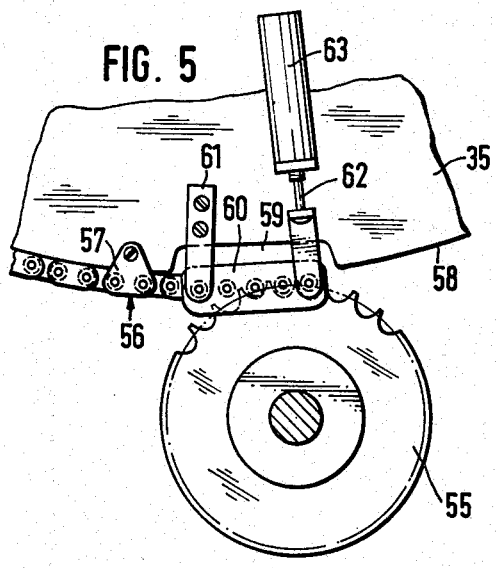
FIG. 6
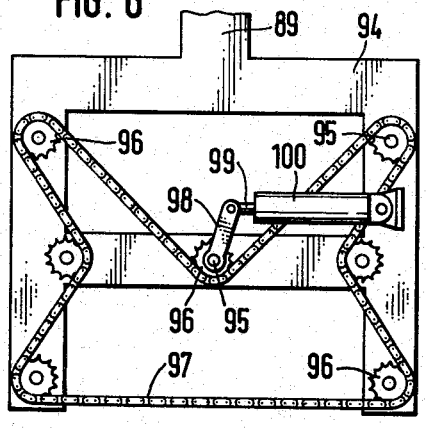

FIG. 14
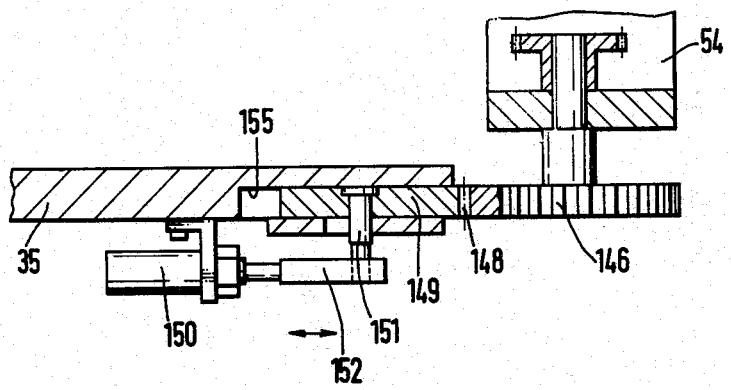
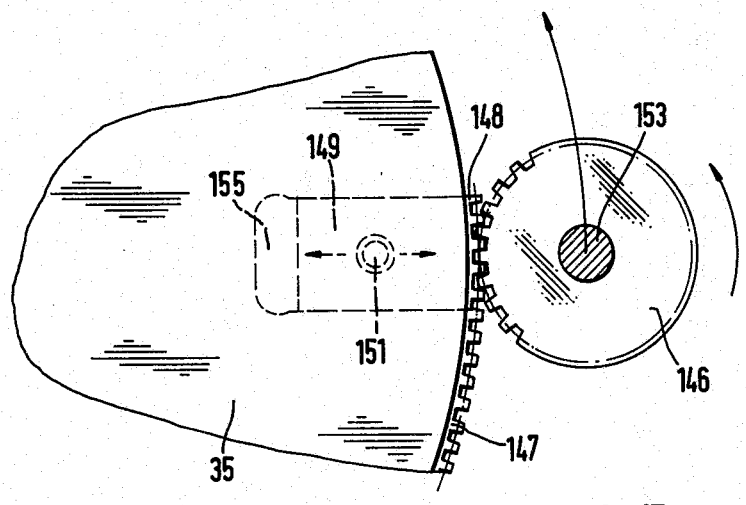
FIG. 15

APPARATUS FOR THE MANUFACTURE OF REINFORCED PANTIES

BACKGROUND OF THE INVENTION

The invention relates to techniques for the manufacture of peripherally contoured fabric blanks that are adapted to be folded over and sewn to form a finished panty, and more particularly to techinques for forming such blanks when the latter are provided with reinforcing strips located at the crotch area of the finished panties.

In known techniques of this type, the contoured blanks for the panties are initially cut out or punched out of a cloth web that is continuously or cyclically withdrawn from a delivery spool. The so-formed blanks are then subjected to a further hand or machine operation in which suitable edge seams are sewn on the opposed contoured surfaces of the panty blank, after which the blank is folded over and sewn along its remaining edges to complete the waist and leg openings of the finished garment.

In the event that a crotch reinforcement for the finished panty is desired, a separate joining and seaming operation must be effected on the cut-out or punched-out fabric blank, after which the reinforced blank must be separated from the remainder of the reinforcing strip.

Such prior-art techniques for the manufacture and reinforcement of peripherally contoured fabric blanks for panty manufacture have been found to be slow and inefficient.

SUMMARY OF THE INVENTION

The present invention provides a rapid and efficient automatic technique for the manufacture and reinforcing of peripherally contoured fabric blanks that are adapted to be folded over and sewn in later operations to form finished panties. In an illustrative embodiment, a plurality of blank-forming fabric segments, each larger than the contoured periphery of the final blank, are cyclically advanced on a conveyor in overlying relation to a reinforcing strip whose longitudinal edges are parallel to the direction of advance and whose width is smaller than the width of each of the segments.

The output end of the conveyor is in registration with a first of a plurality of work stations that are circumferentially distributed around the periphery of a turret that is rotatably carried on a fixed support.

A plurality of spider-like turret arms extend from the turret periphery, each arm carrying on its outer end a rotatable, magnetically-actuable fabric holder whose cooperating upper and lower plates are peripherally contoured identical in size and in configuration to the fabric blanks.

As each segment advances to the outward end of the conveyor, the edges of the underlying reinforcing strip are sewn thereto, and each so-reinforced segment is severed from the remainder of the strip. Each severed reinforced segment is introduced into the then-aligned holder at the first work station. The corresponding turret arm is then indexed into a first one of four successive work stations, at which separate contour sewing machines are disposed.

As the segment is carried by the arm from the first work station to the first second work station and thereafter to the remaining three work stations, the associated holder is successively rotated through 90° to present four different portions of the holder periphery to the respective sewing machines at the second work stations. Each sewing machine is adapted to cut off the area of the first segment projecting beyond the confronting portion of the holder periphery, after which the sewing machine sews an edge seam on the segment along the contour of the periphery of such holder portion.

As a result, the segment exiting from the last of the second work stations has the form of the final panty blank, complete with edge seams around substantially the entire periphery thereof. At this point, the turret can then be indexed into a discharge station, where the finished blank can be removed from the holder and folded over parallel to the seams of the central reinforcing strips thereon, and thereafter sewn to complete the panty manufacture. In order to effect the required 90° rotation of each holder as the associated arm is indexed between successive work stations, a transmissions element such as a chain or a sun gear segment is secured to the periphery of the fixed turret support, and extends between the first work station and the last of the second work stations. A second transmission element, which in the case of the above-mentioned chain is in the form of a sprocket and in the case of the above-mentioned segment is in the form of a gear, is rotatably carried on the inner end of the same turret arm. The second transmission element is adapted to roll along the first transmission element as such turret arm is indexed between successive work stations, and the rolling movement of such second transmission element is dynamically converted, by suitable facilities associated with the same arm, to the required rotational motion of the holder.

In an additional feature of the invention, the respective ends of the first transmission element are selectively decoupled from the remainder of such element to stop the rotation of each holder in the correct position at the first work station and at the last of the second work stations. Illustratively, such decoupling device may be a hinged or slidable element that carries the end chain links or gear teeth, as the case may be, for the respective embodiments of the first transmission element indicated above.

Additionally, each holder may be maintained immobilized in the desired position at each of the second work stations by means of a lever-actuated bolt which cooperates with one of a plurality of slots in the lower plate of the holder, the lever-actuating mechanism being disposed at each relevant work station.

In order to support the portions of the areas of the holder-carrying fabric segments that project beyond the contoured periphery of the holder until such portions are to be cut away and seamed, a pair of auxiliary holder plates are associated with the main lower plate of each holder. Each of such auxiliary plates has a peripheral contour that is complementary to and interfitting with the contours of respective opposed portions of the main contoured lower plate. Suitable means, such as a pneumatic piston-cylinder set, are provided for selectively moving the auxiliary plates into and out of registration with the main lower plate.

In order to releasably secure each fabric segment in the holder, the main upper and lower plates of such holder are provided with cooperable permanent magnets, with the magnet in the upper plate being rotatable to present a selected one of its poles opposite the poles of the magnet in the underlying lower plate. The upper magnet may illustratively be rotated by means of a follower arm that is rotatably coupled to a carrier member, which in turn is supported for reciprocal movement between the first work station and the discharge work station immediately downstream of the last second work station.

BRIEF DESCRIPTION OF THE DRAWING

The invention is further set forth in the following detailed description taken in conjunction with the appended drawing, in which:

FIG. 1 is a top view of a portion of an automatic installation for cutting and reinforcing fabric segments that are to be later worked into peripherally contoured fabric blanks in accordance with the invention;

FIG. 2 is a side elevation of the installation of FIG. 1;

FIG. 5 is a fragmentary enlarged top view of a portion of the arrangement of FIG. 3, illustrating one embodiment of an apparatus for rotating each work holder as the associated turret arm is indexed between successive work stations;

FIG. 6 is an enlarged plan view of a portion of the arrangement of FIG. 3, illustrating a technique for providing selective magnetic coupling between opposed upper and lower plates of each fabric holder;

FIG. 7 is a fragmentary view in section of a portion of the arrangement of FIG. 4, illustrating one manner of engaging and rotating a magnet associated with the upper plate of each holder means;

FIG. 8 is a sectional view taken along line 8—8 of FIG. 7;

FIG. 9 is a fragmentary view, similar to FIG. 7, but illustrating an alternative manner of rotating the magnet in the upper plate of the holding member;

FIG. 14 is an enlarged fragmentary view of a portion of the arrangement of FIG. 13; and FIG. 15 is a plan view of the arrangement of FIG. 14.

DETAILED DESCRIPTION

Figure 3:
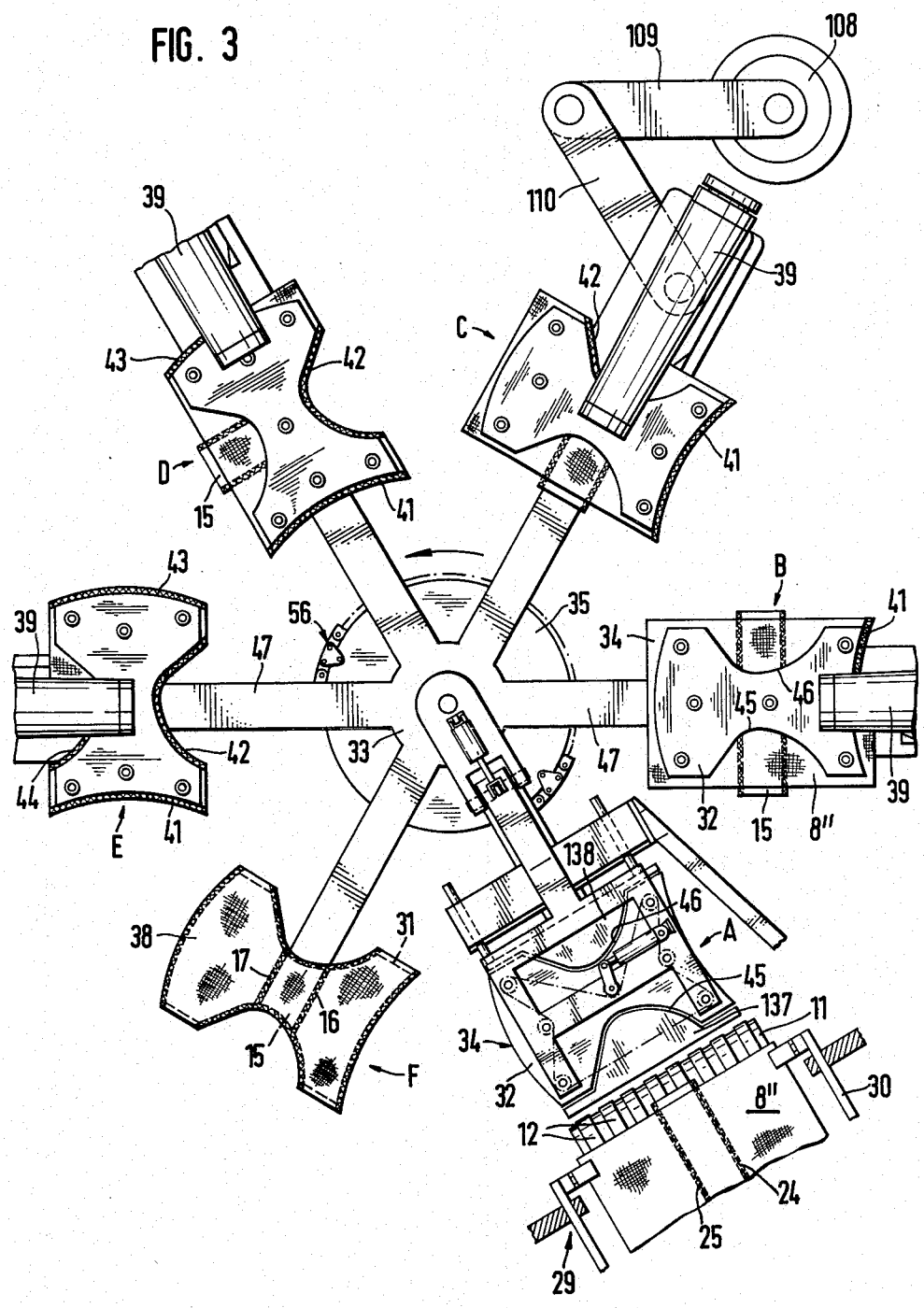
FIG. 3 is a top view of a turret-like installation for receiving reinforced fabric segments from the installation of FIGS. 1–2 and successively forming adjacent areas thereof into a peripherally contoured fabric blank having edge seams thereon.

Referring first to FIGS. 1–2, an illustrative manufacturing installation constructed in accordance with the invention for the production of peripherally contoured panty blanks includes a delivery roller 2 supported on a drive axis 1. The roller 2 is wound with a web 3 of a suitable fabric forming the basic constituent of the blank. The web 3 is pulled from the roller 2 in the form of hanging loops which extend between the roller 2 and a plurality of delivery rollers 4 in the nip of which the web 3 is suitably advanced to a conventional storage area 6. Downstream of the area 6 is a circular knife 7, which is movable transversely to the direction of advance of the web 3 and forwardly of a discretely recessed front surface 201 of the area 6, such movement of the knife serving to separate individual fabric segments 8 from the web 3. As shown, the segments 8 are substantially rectilinear in shape, and have an overall size larger than the blanks to be manufactured. Upon the cutting of each segment 8, a selvedge 9 is produced on the remaining front surface of the web 3 within the area 6.

A plural-band conveyor 12 is supported on a pair of shafts 10 and 11 downstream of the storage area 6 for receiving the cut-off segments 8 from the storage area 6. The conveyor 12 extends along an axis 202 perpendicular to the longitudinal direction of advance of the web 3 and the separated segments 8. The length of the bands of the conveyor 12 is suitably chosen so that the conveyor 12 can accommodate at least three segments (designated 8, 8′, 8″) at any one time.

A shaft 13 is supported parallel to and upstream of the shaft 10, such shaft 13 serving to support a delivery roller 14 on which a reinforcing band 15 is wound. The band 15 may illustratively be a web of cotton or the like for reinforcing the portion of the segments 8 which will ultimately correspond to the crotch area of the finished panties.

The band 15, pulled from the roller 14, is advanced centrally along the conveyor 12 in alignment with and directly below the lower surface of the segments 8 as shown in FIG. 2, with the opposed longitudinal edges (designated 16 and 17) of the band 15 overhanging the underlying bands of the conveyor 12.

A tong-actuating mechanism 18 is arranged in alignment with the rollers 4 on the opposite side of the conveyor 12. The mechanism 18 carries a plurality of tongs 19, which may be selectively opened or closed by a pneumatic cylinder 20. In particular, the tongs 19 are connected with push rods 21 of the cylinder 20, whereby the tongs are movable in a direction to the left as viewed in FIG. 1 from an inactive position to a selvedge-gripping position wherein the tongs extend into recesses 5 in the front surface of the storage area 6 to grip the selvedge 9 of the web 3.

A pair of sewing machines 22 and 23 are arranged perpendicular to the direction of advance of the conveyor 12. The sewing heads of the machines are positioned in alignment with the lateral edges 16 and 17 of the reinforcing band 15, in order to sew the edges 16 and 17 on the underlying segment 8′ to form overlapping seams 24 and 25.

A circular knife 26 is supported behind the machine 23 perpendicular to the direction of advance of the conveyor 12. The knife 26 is movable cyclically across the band 15 in order to separate the reinforced segments from the main portion of the band 15.

The longitudinal edges of the reinforced segments 8″ are engaged by a plurality of tongs 28 of a second actuating mechanism 29 similar to the mechanism 18. The tongs 28 are operated via pushrods 30 to pull the reinforced segments 8″ from the position represented in FIGS. 1 and 3, at the outlet end of the conveyor 12, onto a contoured lower plate 31 of a magnetically-actuated holder 34.

A plurality of the holders 34 are individually rotatably carried on outer ends of six circumferentially spaced radial arms 47, whose inner ends are secured to the periphery of a rotary turret 33.

The contour of each lower plate 31 corresponds to that of the panty blank (designated 38 in FIG. 3) to be manufactured, and is smaller than such blank by about twice the width of the peripheral edge seams to be sewn on such blank in the manner described below. Each plate 31, correspondingly, has peripheral cutouts 45 and 46.

Each holder 34 also has an upper plate 32 identical to and cooperable with the contoured lower plate 31.

The turret 33 is rotatably carried in a fixed support 35, and is cyclically driven by a motor 37 by means of a hollow shaft 36. The turret 33 serves to circumferentially index the reinforced segment 8'' from an input position A (FIG. 3), in which the tong mechanism 29 pulls the segment onto the lower plate of the then-aligned one of the holders 34, and thereafter through four successive sewing positions B–E, in which the segment 8'' is shaped into the panty blank 38, and finally to an output position F, in which the blank 38 can be removed from the installation for further processing. Such processing can take the form, for example, of folding the blank 38 parallel to the reinforcing seams 16, 17, and then sewing the now-confronting edges of the folded garment to form the waist and leg openings of the garment.

In each sewing position B–E, a separate contour sewing machine 39 (FIGS. 10–11) is arranged. Each machine 39, which may be a twin-needle overlap seam machine, is equipped with a knife 40 for cutting away of the excess area of the segment 8'' which extends beyond the associated peripheral portion of the holder 34. The knife 40 is adapted to cut the excess segment area shortly before the stitching operation, so that the resulting selvedge is taken into account in the final edge seam. Specifically, edge seams identified at 41–44 are respectively sewn by the machines 39 on the segments 8'' at the successive stations B–E to complete the blank.

Figure 4:
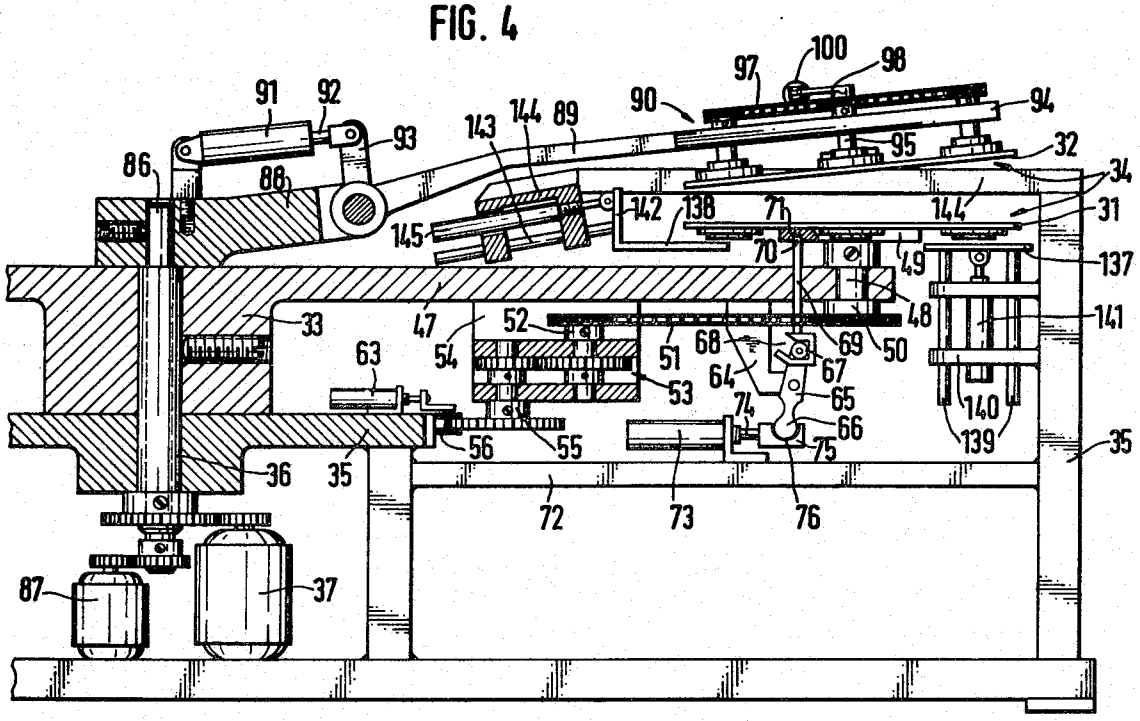
FIG. 4 is a sectional view taken along line 4—4 of FIG. 3, illustrating details of the first work station serviced by the installation of FIG. 3.

The outer end of each arm 47 supports a vertical shaft 48 (FIG. 4) for rotation therein. Each shaft 48 in turn carries a cross-shaped member 49, to which the lower plate 31 of the associated holder 34 is affixed.

A sprocket 50 is secured to the lower end of each shaft 48. Each sprocket 50 is connected over a chain 51 with a sprocket 52, which forms the output of a speed-reducer 53 carried by an angle member 54 on the associated arm 47.

A sprocket 55 is mounted on the input end of the arm 47, and forms the input of the speed reducer 53. The sprocket 55 is adapted for rolling movement on a chain 56, which is secured by means of tongues 57 (one of which is shown in FIG. 5) disposed on a circular edge surface 58 of the support 35. As indicated below, the rotation of the sprocket 55 during the circumferential indexing movement of the turret 33 will effect a rotational movement of the holder 34 at the outer end of the same arm via the speed-reducer 53 and the shaft 48.

As indicated in FIG. 3, the chain 56 extends around an angle of about 240°, with a first end thereof arranged in the input position A and the other end in the last sewing position E. In FIG. 5, the end portion of the chain terminating in the position E is provided with facilities for decoupling such chain end from the then-adjacent sprocket 55. (A substantially identical decoupling arrangement is provided at the input position A).

In particular, the portion of the edge surface 58 of the support 35 adjacent the position E has a cutout 59 (FIG. 5), which receives a member 60 that carries the last several links or rollers of the chain 56 in operative alignment. The member 60 is hinged at one end to a holder 61 carried on the support 35. The free end of the member 60 is pivoted to an operating rod 62 of a pneumatic cylinder 63, which in turn is pivotally coupled to the support 35.

Each of the arms 47 (FIG. 4) is equipped with a carrier 64, on which a lever 65 is hinged. One end of each layer 65 has a spherical head 66. The other end of the lever has a roller 67, which is received in a curved groove 68 of a bolt 69. The bolt 69 in turn is movably supported in the arm 47, and has a conical upper end 70 which is received in one of four conical bores 71 disposed on each arm of the cross-shaped carrier 49 on the outer end of the arm 47. When the bolt 69 is engaged in the bore 71, the associated holder 34 affixed to the carrier 49 is effectively immobilized against rotation.

A carrier arm 72 is secured to the support 35 at each of the positions A-E. A pneumatic cylinder 73 is arranged on each arm 72. Each pneumatic cylinder 73 is provided with an operating rod 74, which has a switching head 75 with a semi-circular cutout 76 for selectively receiving the spherical head 66 of the lever 65.

The lower plate 31 of each holder 34 (FIG. 7) has a plurality of circular recesses 77, each of which may be covered by means of a take-up plate 78 secured on the underside of the lower plate 31. A circular permanent magnet 79 is secured in each plate 78, and has sector-shaped poles that extend upwardly into the associated recess 77 to terminate flush with the upper surface of the lower plate 31.

The upper plate 32 cooperates with the lower plate 31 to securely hold the reinforced segment 8'' during its formation into the blank 38. The upper plate 32 is provided with a plurality of recesses 80 corresponding to the recesses 77 in the lower plate 31. Each recess 80 is covered by means of a take-up plate 81 rotatably supported in a covering ring 82 secured to the upper plate 32. A permanent magnet 79 is mounted in each take-up plate 81 and extends downwardly into the associated recess 80 to terminate flush with the lower surface of the upper plate 32. Each take-up plate 81 is also provided with an inclined annular wall 83 (FIG. 8), which surrounds a bore 84 and is interrupted by two radial slots 85.

A shaft 86 is coaxially supported in the hollow shaft 36 (FIG. 4) on the turret 33 for independent rotation therein. The shaft 36 is driven by a motor 87. A support piece 88 is secured to the upper end of the shaft 86 projecting outside the turret 33.

An arm 89 of a holder plate transfer arrangement 90 is supported for vertical oscillation on the piece 88 and for reciprocation between the positions F and A illustrated in FIG. 3. A penumatic cylinder 91 (FIG. 4) rotatably supported on the piece 88 serves for oscillation of the arm 89; for this purpose, the cylinder 91 is provided with an operating rod 92 which engages a lever 93 fixedly connected with the arm 89.

A frame 94 (FIGS. 6–9) is secured on the front end of the arm 89. A plurality of shafts 95, corresponding to the number of take-up plates 81 arranged on the upper plate 32 and thereby with the number of bores 84, are supported on the frame 94. The shafts 95 are so constructed and arranged that they cooperate for joint movement into the several bores 84 of the plates 81.

As indicated in FIG. 7, a plurality of sprockets 96 are secured to the shafts 95, and are mutually interconnected by means of a chain 97. A lever arm 98 shown in dashed lines in the figure is connected with one of the shafts 95, and an operating rod 99 is hinged to the arm 94. The operating rod 99 is associated with a pneumatic cylinder 100 supported on the frame 94.

Each shaft 95 has a follower 101 (FIG. 9) disposed on its lower end. The follower 101 extends into the radial slots 85 of the annular wall 83 (FIG. 8) in each plate 81 during the insertion of the corresponding shaft 95 into the appropriate bore 84. The side walls of the radial slots 85 have engagement surfaces for the follower 101. In addition, two of the illustrated shafts 95 are provided with followers 104 (FIGS. 7–8). The followers 104 terminate in bolts 105, which during the rotation of the shafts 95 selectively enter recesses 106 which are disposed in blocking pieces 107 attached to the covering rings 82.

Four fixed supports 108 are provided outside the rotary turret 33 (FIG. 3) at the respective positions B–E. Respective arms 109 are hinged to the supports 108. An arm 110 (FIG. 10) is pivotally joined to each arm 109. A plate 111 is rotatably connected to the arm 110 for carrying the associated one of the four sewing machines 39.

A drive motor 113 is secured to a carrier 112 beneath each plate 111. By means of bevel gears 114, 115, the drive motor 113 operates a shaft 117 that is supported in the carrier 112 essentially coaxial with the needles 116 of the sewing machine 39.

A sprocket 119 is secured to the shaft 117 for engagement with a chain 118. The chain 118 is carried on a side wall 120 of a patterning mechanism 121, which is fixedly secured to the support 35 and along which the machine 39 is adapted to move to cut and sew one of the edge seams on the contoured blank being manufactured. In particular, the profile of the mechanism 121 at each of the stations B–E corresponds to the shape of the appropriate one of the edge seams 41–44 (FIG. 3). Therefore, as the machine 39 is moved along the profiling mechanism 121, the needles 116 of the machine 39 will define the contours of the appropriate edge seam.

A spacing roller 122 (FIG. 10) is supported on the shaft 117 for rolling movement on one side wall 120 of the profiling mechanism 121 in the direction of cutting and sewing of the machine 39, i.e., a direction perpendicular to the plane of the drawing. A pair of rods 123 (only one of which is visible in the drawing), extend parallel to the longitudinal axis of the machine 39 and are guided in the carrier 112, whose ends are secured with each other by means of an angle 124. A pair of parallel shafts 125, only one of which is visible in the drawing, are secured in the angle member 124. The shafts 125 individually carry counter rollers 126, which are individually supported for rolling movement, one behind the other, perpendicular to the plane of the drawing along a side wall 127 of the profiling mechanism 121. The spacing roller 122 and the counter rollers 126 are pressed against the respective side walls 120 and 127 by means of a pair of springs 128 supported in the angle member 124 and the carrier 112. The shafts 125 of the counter rollers 126 and the shaft 117 of the roller 122 are arranged to define corners of an isosceles triangle whose plane extends perpendicular to the plane of the paper, with the apex of such triangle being disposed along the axis of the shaft 117. With such construction, a frictionally closed, three-point linkage for accurately moving the sewing machine 39 in the desired contoured path is accomplished.

As elongated guide plate 129 (FIGS. 10–11) is disposed immediately upstream of the stitching position of each sewing machine 39. The plate 129, which extends in the direction of advance of the sewing machine, is secured to a lever arm 130, which is rotatably supported parallel to a shaft 132 also extending in the direction of advance. The shaft 132, which is disposed beneath an edge 131 of the guide plate 129 remote from the holder 34, is carried on a support arm 133 secured to the sewing machine 39.

The guide plate 129 exhibits an upward incline in the direction of advance, while its upstream end terminates in a downward bend. The lever arm 130 is actuated by an operating rod 135 of a pneumatic cylinder 136, which is pivotally secured on the machine 39. With this arrangement, the cylinder 136 is adapted to oscillate the guide plate 129 between the operative sewing position shown in FIGS. 10–11 and a rest position which is tilted off to the left as viewed in the drawing.

In order to avoid ripples or pulls of the outer portions of the segments 8″ (FIGS. 3–4) that would normally hang over the periphery of the support plate 31 during the transfer of the segment to the plate 31 in the input position A, the holder 34 is further provided with a pair of auxiliary lower support plates 137 and 138. The plates 137 and 138 are respectively contoured in a manner complementary to the plate 31 as described below.

The auxiliary plate 137 is secured on two parallel displacement rods 139, which are movable vertically in a carrier arm 140 secured to the support 35. The rods 139 are displaceable, by means of a pneumatic cylinder 141, between a rest position underneath the lower plate 31 and a working position in which the top surface of the auxiliary plate 137 is in alignment with the top surface of the plate 31.

Specifically, the contour of the auxiliary plate 137 is selected to be complementary to the cutout 45 (FIG. 3) on one side of the lower plate 31, and to enter the cutout 45 when moved into its working position.

The other auxiliary support plate 138, whose form is complementary to the cutout 46 on the opposite side of the lower plate 31, is connected over an angle member 142 with two parallel push rods 143. The rods 143 are supported, with a slight incline, in a carrier arm 144 fixedly connected with the support 35. A pneumatic cylinder 145 is provided for moving the support plate 138 between its inoperative and working positions.

The manner of indexing of the arms 47 with the turret 33 in the manner shown in FIG. 3 is fully conventional, and is instrumented with standard pneumatic construction and control techniques.

The operation of the arrangement thusfar described is as follows. After each segment 8 (FIGS. 1–2) is advanced by the conveyor 12 to the position of the segment 8′, the push rods 21 of the tong actuating mechanism 18 are displaced to the left, and the tongs 19 are placed in their open position. In the left end position of the mechanism 18, the tongs 19 extend into the recesses 5 of the storage area 6, after which the pneumatic cylinder 20 closes the tongs 19 to grip the edge 9 of the web 3. Upon a following retractive (right-ward) movement of the mechanism 18 obtained by an opposite stroke of the push rod 21, the rod 21 pulls the web 3 over the conveyor 12 and into contact with the underlying reinforcing band 15. In order to prevent any binding of the web during the retractive movement of the mechanism 18, the delivery rolls 4 may be synchronously operated at that time.

After the mechanism 18 has been retracted to its initial position shown in FIG. 1, the drive of the circular knife 7 is actuated to separate the segment 8 from the remainder of the web 3.

After the return of the knife 7 into its starting position, the conveyor shafts 10 and 11 are rotated, whereby the segments 8 and the underlying band 15 are moved to the position of the segments 8'. At the same time, the segment 8' disposed previously at such latter position is moved to the position of the segment 8", and so forth. During the advance of the conveyor, the sewing machines 22 and 23 are operated, whereby the two longitudinal edges 16 and 17 of the band 15 are sewn onto the overlying segment 8" to form seams 24 and 25.

As soon as each segment 8 has reached the position of the segment 8' represented in FIG. 1, the drive of the conveyor 12 and the sewing machines 22 and 23 is switched off, and the web 3 is again pulled onto the conveyor 12 via the tong mechanism 18.

At this time, the knife 28 is actuated to cut the aligned portion of the band 15, thereto separate the fully reinforced segment 8" from the segment 8' disposed rearwardly thereof.

Before the now-separated, reinforced segment 8" on the conveyor 12 (FIG. 3) is advanced from the output position of the conveyor onto the lower plate 31 of the holder 34 then disposed in the input position A of the rotary turret 33, the pneumatic cylinders 141 and 145 (FIG. 4) are operated to move the lower auxiliary support plates 137 and 138 from their rest position to their operated position. In such operated position, the upper surfaces of the plates 137 and 138 cooperate with the upper surface of the contoured lower plate 31 to provide a wide-area planar support surface that accommodates the relatively large rectangular periphery of the segment 8".

The pneumatic cylinder 63 (FIG. 5) at the last sewing position E oscillates the member 60 out of its normal position in the cutout 59, so that the links at the associated end of the roller chain 56 engages the then-aligned sprocket 55. The pneumatic cylinder 63 disposed at the input position A is correspondingly operated to engage the other end of the chain 56 with the adjacent sprocket 55.

Also, at this time the lever 65 (FIG. 4) is maintained in its normal position, wherein the end 70 of the bolt 69 is pushed into the then-aligned bore 71 of the holder 49 to immobilize the lower plate 31 on the associated arm 47.

Immediately prior to the time that the segment 8" is moved into the input position A (FIG. 3), the arm 89 (FIG. 4) of the transfer arrangement 90 (which is assumed to be at the position F) is lowered by lever 93, by operation of the pneumatic cylinder 91, to push the shafts 95 (FIGS. 6–9) connected to the frame 94 into the bores 84 of the upper plate 32 of the holder 34 then situated at position F. The followers 101, 104 are thereby moved into the corresponding radial slots 85.

The cylinder 100 (FIG. 6) is then actuated to turn the lever 98, which causes the sprocket 96 on the associated shaft 95 to advance the chain 97 and thereby to rotate the remaining shafts 95. As a result, each bolt 105 is rotated into the capturing recess 106 of the blocking piece 107, thereby securing the frame 94 to the upper plate 32 of the holder 34.

Such latter rotation also causes the followers 101, 104 to rotate the take-up plates 81 (FIG. 7), so that the poles of the magnet 79 associated with the upper plate 32 comes into registration with like poles of the magnet 79 of the lower plate 31. This action eliminates the magnetic attraction of the plates for each other.

Once the plates 31 and 32 are magnetically decoupled, the cylinder 91 may be actuated to lift the arm 89 (with its now-secured plate 32), after which the motor 87 moves the transfer arrangement 90 from position F to position A for operation as indicated below.

At such position A, the longitudinal edges of the segment 8" at the outlet end of the conveyor 12 are now gripped by the tongs 28 (FIG. 3), which via the displacement of the rods 30 serve to move the segment 8" onto the composite planar support surface defined by the lower plate 31 and the auxiliary support plates 137 and 138 of the then-aligned one of the holders 34.

Once the segment 8" is situated on the lower plate 31 at station A, the pneumatic cylinder 91 is again actuated to move the upper plate 32 now carried by the overlying frame 94 onto the top surface of the segment 8" supported on the lower plate 31. The cylinder 100 (FIG. 6) then oscillates the lever 98 via its operating rod 99, whereby the sprocket 96 connected therewith turns the chain 97 in the opposite direction, and thereby imparts an opposite rotation to the shafts 95.

As a result, the followers 101, 104 arranged on the shafts 95 (FIGS. 7–9) rotate the associated take-up plates 81, and consequently the permanent magnets 79 therein, to place the poles of the magnet 79 associated with the top plate 32 into registration with the unlike poles of the magnet 79 situated in the lower plate 31. The resulting magnetic attraction causes the segment 8" to be securely clamped between the plates 31 and 32.

During the last-mentioned opposite rotation of the shafts 95, each bolt 105 (FIG. 8) is rotated out of the associated holding recess 106 of the blocking plate 107, so that the connection between the frame 94 of the transfer arrangement 90 and the top plate 32 is released. Accordingly, during a subsequent lifting of the arm 89 (FIG. 4) by means of the pneumatic cylinder 91, the upper plate 32 remains securely connected with the lower plate 31 at position A, while the arrangement 90 may be rotated back empty to the output position F.

The two lower support plates 137 and 138 at position A are now pulled back into their rest position by means of the cylinders 141 and 145, so that the outer end of the segment 8" overlap the periphery of the plates 31, 32. Simultaneously, the cylinder 73 oscillates the lever 65 over the switching head 75, whereby the lever 65 pulls the bolt 69 downwardly to disengage the conical end 70 of such bolt from the opening 71 in the holder 45. As a result, the holder 34 is free to rotate as the turret 33 is indexed.

The motor 37 is now actuated to index the turret 33 by 60° via the shaft 36. During the rotation of the turret 33, the sprocket 55 on each arm 47 extending between the positions A–E rolls on the chain 56. Such action effects, over the speed reducer 53 and the shaft 48, a simultaneous rotation of the holder 34 through 90° with respect to the arm 47. (Because of the absence of the chain 56 between positions E and A in the downstream direction, the holders 34 on the arms which are then movable between these positions do not rotate).

During the indexing of the holder 34, the cylinder 63 (FIG. 5) at position E rotates the element 60 carrying the end of the chain 56 back into its original position within recess 59, so that the sprocket 55 on the arm 47 moving into position E is accurately stopped in this position. At the same time, the corresponding cylinder 63 located in position A oscillates its associated element 60 into the recess 59, so that the opposite end of the chain 56 is decoupled from the sprocket 55 that is connected with the arm moving from position F to position A.

In order to prevent any further rotational movement of the holders 34 as they enter the positions A–E, the spherical head 66 of the lever 65 disposed at each such position enters the cutout 76 of the switching head 75.

The apparatus functions associated with the sewing positions B–E and the output position F will now be briefly described.

At the instant in which the auxiliary support plates 137 and 138 are lifted into operative positions in cooperation with the lower plate 31 in position A in the manner described above, the cylinders 73 in each of the sewing positions B–E are actuated to oscillate the lever 35 over the operating rod 34, so that the lever 65 pushes the bolt 69 into the bores of the holder to arrest the rotation of the holder 34. After the locking of the holder 34 by the bolts 69 at positions B–E, the motor 113 at each of such positions B–E (FIG. 10) move the shaft 117 into operative position via bevel gears 114, 115. The sprocket 119 thereupon rolls on the chain 118 and advances the associated sewing machine 39 along the contour of the profiling mechanism 121. Because of the above-described frictionally closed, three-point linkage between the spacer roller 122 and the counter rollers 126, the sewing machine 39 will always be aligned accurately perpendicular to the tangent to the curved walls of the profiling member 121.

Figure 10:
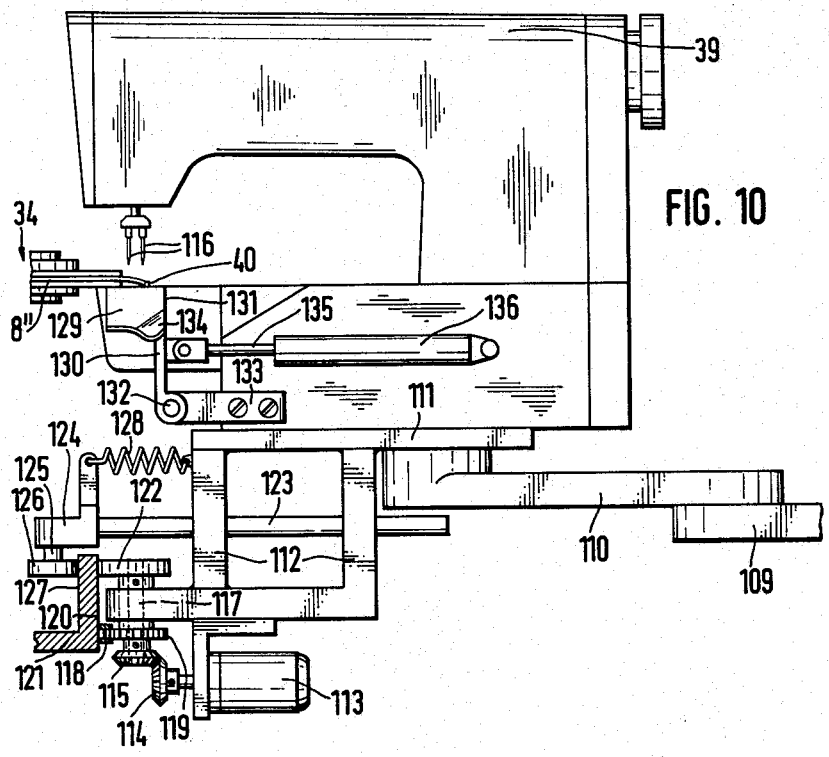
FIG. 10 is a side elevation of an additional work station associated with the turret arrangement of FIGS. 3 and 4, illustrating a contour sewing machine and associated facilities for its positioning and operation.
Figure 11:
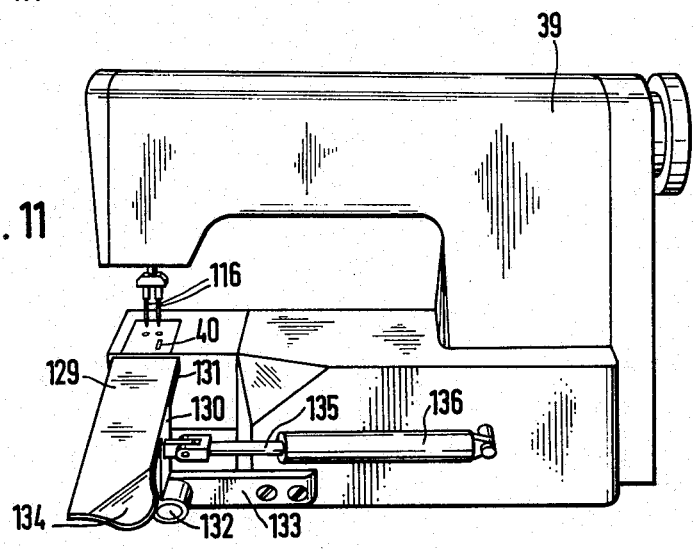
FIG. 11 is a perspective view of the sewing machine of FIG. 10, illustrating further details of a reciprocable guide plate disposed upstream thereof.

During the time that each sewing machine 39 is moved into operative position, the guide plate 129 is oscillated, by means of the cylinder 136 and the rod 135, from its tipped rest position to its operative position in alignment with the sewing platform of the sewing machine. When the plate 129 is in its operative position, it supports and smooths the adjacent overlying, overhanging edge of the segment 8″ extending beyond the periphery of the holder 34 (FIG. 10). Such smoothing operation is aided by the upward inclination of the top surface of the plate 129, and by the downwardly rounded-off rear corner 134 thereof.

As the sewing machine 39 advances along the profiling mechanism 121, such machine is operated to sew the appropriate one of the peripheral edge seams 41–44 (FIG. 3) on the segment 8″ tensioned in the holder 34, while the overlying fabric edge is cut off with the knife 40.

After the successive formation of the edge seams 41–43, the associated holder 34 at positions B–D is unlocked through operation of the cylinder 73 as already described. In the sewing position E, however, the holder 49 remains connected with the arm 47 after formation of the seam 44. To accomplish this, the cylinder 63 at position E also oscillates the element 60 into the cutout 59, so that the adjacent end of the chain 56 is decoupled from the sprocket wheel 55.

After this, turret 33 (FIG. 4) may be indexed in the manner described above, while at each of the positions B–E spherical head 66 of the lever 65 moves into the cutout 76 of the associated switching head 75. During such indexing movement, the drive motor 113 (FIG. 10) of each sewing machine 39 moves back along the profiling mechanism 121 in the opposite direction to the starting position.

When the now-completed blank 38 is transferred from the last sewing position E to the delivery position F, the upper plate 32 of the holder 34 at position F is lifted off the lower plate 31 by the transver mechanism 90 to expose the finished blank 38. At this time, such blank can be removed by hand or machine for completion of the finished panty.

FIGS. 12–15 illustrate a modified arrangement for rotating the holder 34 on the arm 47 while such arm is circumferentially indexed between successive ones of the positions A–E. Corresponding elements in FIGS. 1–11 and in FIGS. 12–15 have been given corresponding reference numerals.

In the modification of FIGS. 12–15, the chain 56 of FIGS. 1–11, extending between the positions A and E, has been replaced by a sun gear segment 147. Similarly, the sprocket 55 of FIGS. 1–11, carried by the respective arms 47 to roll on the chain 56, has been replaced in FIGS. 12–15 by a planetary gear 146, which is adapted to orbit around the segment 147.

Figure 12:
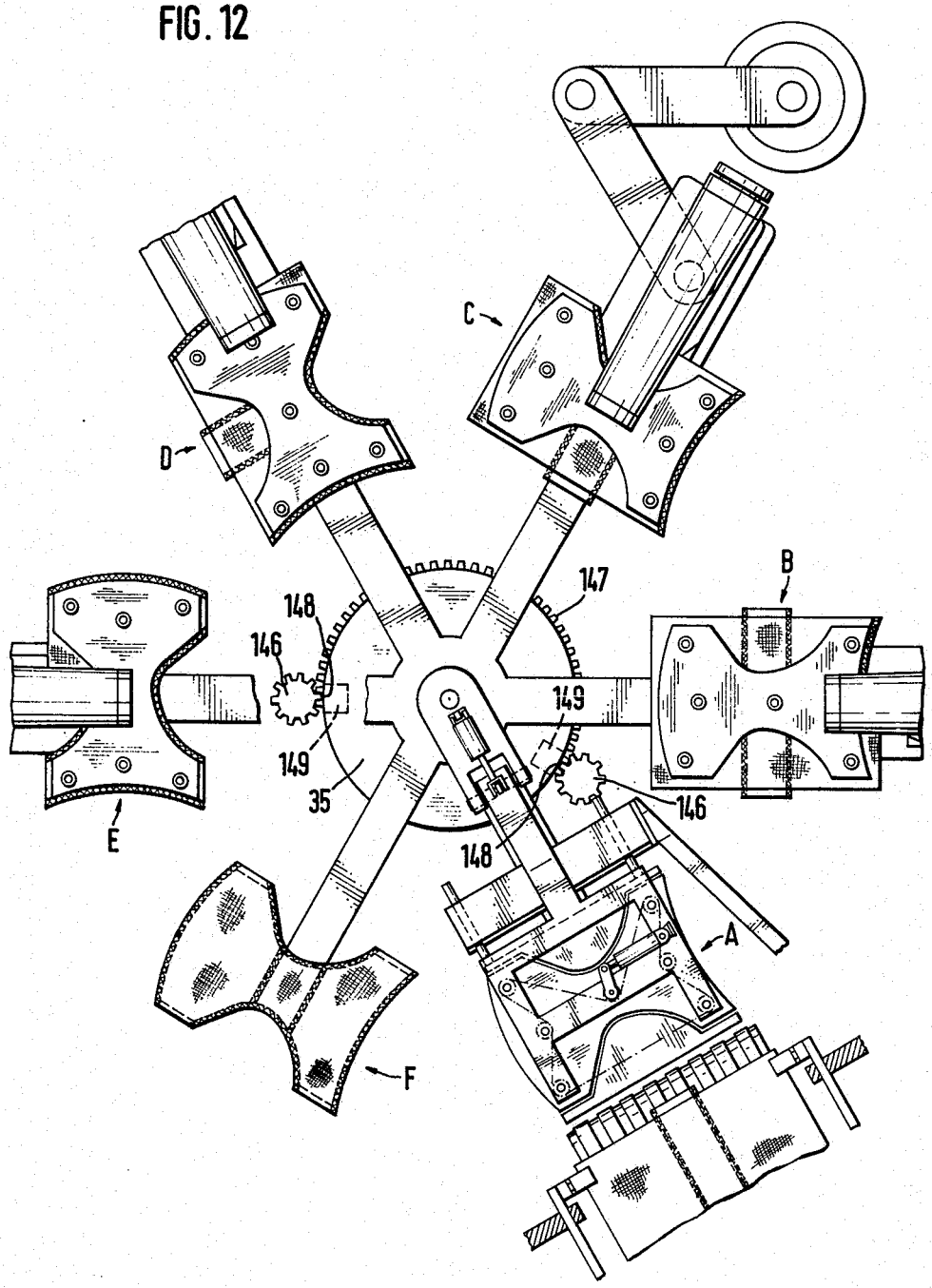
FIG. 12 is a plan view, similar to FIG. 3, illustrating an alternative embodiment of an arrangement for selectively rotating each work station about its axis during the indexing of the associated turret arms between successive work stations.

FIG. 12 illustrates an arrangement for selectively decoupling the planetary gear 146 from each end of the sun gear segment 147. For this purpose, a slider 146 is arranged on the support 35 at each of positions A and E for carrying the end teeth 148 of the segment 147. The slider 149 is adaptable for radial movement between an inward position, in which the teeth 148 are decoupled from the planetary gear 146, and an outer position wherein the teeth 148 are engaged with the gear 146.

Figure 13:
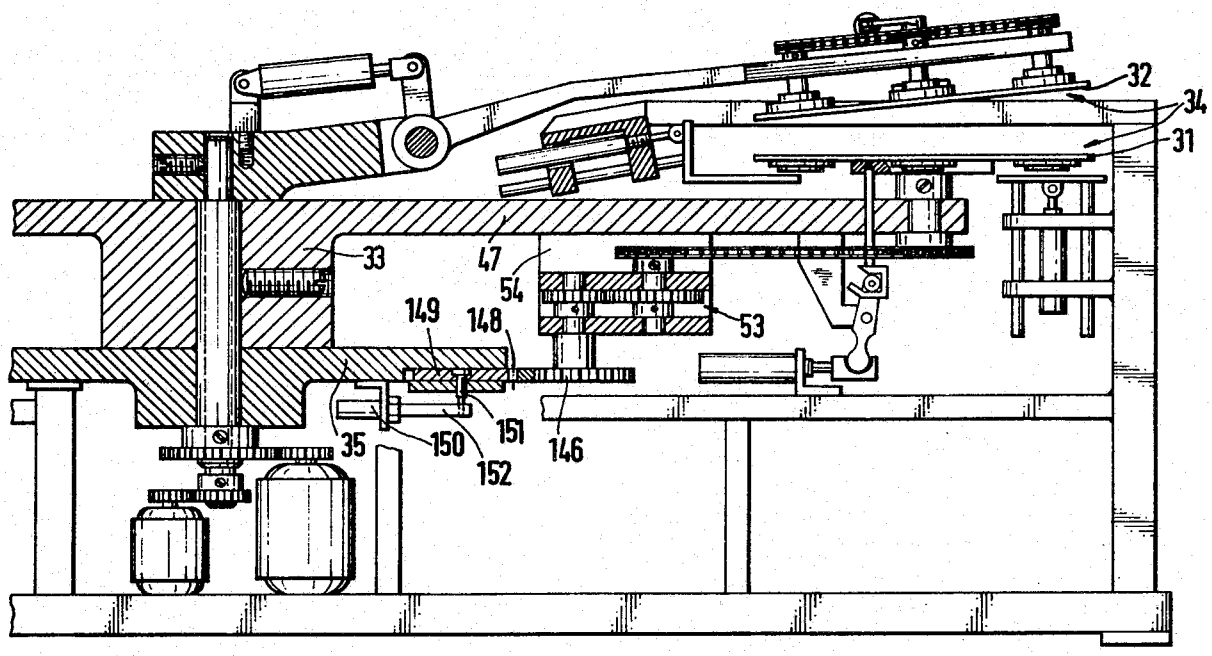
FIG. 13 is a sectional view taken along line 13—13 of FIG. 12, illustrating certain details of the first work station of FIG. 12.

As shown in FIGS. 13–15, the slider 147 is displaceably supported in the radial direction in a cutout 155 of the support 35. The displacement of the slider 149 is accomplished by means of a cylinder-piston set 150 secured to the support 35. The piston rod of the arrangement 150 is connected, over a rod structure 152, with a bolt 151 secured to the slider 149.

Except for the above, the structure and operation of the arrangement of FIGS. 12–15 corresponds identically to that of FIGS. 1–11.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In an apparatus for the automatic manufacture of a reinforced, peripherally contoured fabric blank adapted to be folded over and sewn to form a finished panty, a fixed substantially cylindrical support, a turret rotatably mounted coaxial with the fixed support, plurality of work stations disposed in circumferentially spaced relation around the turret, a plurality of turret arms individually extending radially from the turret at circumferentially spaced positions therealong, means for cyclically indexing the turret to individually position the outer ends of the respective turret arms in registration with the respective work stations, a movable conveyor having an output end terminating at a first one of the work stations, means for loading, onto the input end of the conveyor, a spaced succession of first blank-forming fabric segments each having a peripheral surface larger than the periphery of the contoured blank to be manufactured, means for advancing a reinforcing strip onto the conveyor below and in contact with the lower surfaces of the first segments so that the reinforcing strip is advanced on the conveyor with the first segments, means associated with the conveyor for sewing the edges of the reinforcing strip to the overlying portions of the first segments to reinforce the first segments as the latter and the reinforcing strip advance on the conveyor, associated with the conveyor for cutting the reinforcing strip intermediate the reinforced segments to separate the reinforced segments from the remainder of the reinforcing strip, fabric segment holder means individually rotatably supported on the outer ends of the respective turret arms for receiving and capturing the successive reinforced first segments from the output end of the conveyor, the holder means having a first lower plate and a second cooperating upper plate for selectively capturing the received first segment therebetween, the first and second plates having contoured peripheries corresponding to the contour of the blank to be manufactured whereby an outer area of the captured first segment projects beyond the peripheral surface of the first and second plates, means carried by the turret for rotating each holder means within the associated arm over a prescribed angle as the turret is indexed into prescribed successive second ones of the work stations following the first work station to expose different portions of the holder means periphery to the successive second work stations, and contour sewing machine means operatively disposed at each of the successive ones of the second work stations and cooperable with the then-exposed portion of the holder means periphery for cutting away the associated region of the projecting outer area of the captured first segement and for forming edge seams on said first segment along the periphery of the then-exposed portion of the holder means periphery.

2. Apparatus as defined in claim 1 in which the means for rotating the holder means comprises in combination, a first transmission element carried by the fixed support and extending along the periphery thereof for a first circumferential distance in the direction of advance, the first circumferential distance extending from the first work station to the last of the succession of second stations, a second transmission element rotatably carried by the inner end of each turrent arm and adapted to normally drivingly engage the first transmission element to roll along the first transmission element as said turrent arm is indexed between successive ones of the work stations along the first circumferential distance, and means carried by each turrent arm for dynamically coupling the second transmission element on the inner end of such arm with the holder means on the outer end of such arm.

3. Apparatus as defined in claim 2, in which the apparatus further comprises means movably mounted on the fixed support and disposed at respectively opposite ends of the first transmission element for selectively decoupling, from the first transmission element, each second transmission element then disposed opposite the ends of the first transmission element.

4. Apparatus as defined in claim 3, in which the first transmission element is a chain, and in which the second transmission element is a sprocket adapted to roll along the chain as the associated turret arm is rotated.

5. Apparatus as defined in claim 3, in which the first transmission element is an external sun gear sector secured to the fixed support, and in which the second transmission element is a planetary gear adapted to orbit along the sun gear sector as the associated turret arm is rotated.

6. Apparatus as defined in claim 5, in which the selective decoupling means comprises, in combination, slider means exhibiting a fixed plurality of first external gear teeth forming the teeth at the associated end of the sector sun gear, and means for moving the slider means within the fixed support between a first position in which the first teeth are aligned with the remaining teeth on the gear sector and a second position in which the first teeth are out of alignment with said remaining teeth.

7. Apparatus as defined in claim 1, further comprising means carried by the fixed support and cooperable with each holder means for selectively inhibiting the rotation of each holder means.

8. Apparatus as defined in claim 1, in which the holder means further comprises third and fourth plates individually having contours complementary to and interfitting with the contours of opposed portions of the first lower plate of the holder means, and mean for selectively moving the third and fourth plates into interfitting registration with the opposed portions of the first lower plate to provide a bearing surface for the projecting outer areas of each first reinforced segment that is captured between the first and second plates of the associated holder means.

9. Apparatus as defined in claim 2, in which the holder means further comprises a first permanent magnet secured in the first lower plate, a second permanent magnet rotatably carried in the second upper plate for movement between a first position in which the second magnet is in attractive relation to the first magnet so that the first segment is securely held between the first and second plates and a second position in which the second magnet is in repulsive relation to the first magnet to permit release of the first segment, and means for rotating the second permenent magnet.

10. Apparatus as defined in claim 9, in which the means for rotating the second permanent magnet comprises in combination, a slotted insert supported for rotation in the second upper plate, means for securing the second permanent magnet to the slotted insert, a carrier member coupled to the fixed support for reciprocal movement between the first work station and a third work station disposed between the first work station and the last one of the successive second work stations, and a follower arm rotatably coupled to the carrier member for selectively engaging the slot in the insert to rotate the insert and the second permanent magnet affixed thereto when the follower arm is rotated.

11. Apparatus as defined in claim 1, further comprising guide plate means disposed at each of the second work stations upstream of the associated contour sewing machine means, and means for selectively moving the guide plate means into operative relation with the projecting outer area of the first segment that is captured in the holding means then indexed into the associated second work station.

12. Apparatus as defined in claim 11, in which the portion of the guide plate means remote from the contour sewing machine means is bent downwardly.

13. Apparatus as defined in claim 11, in which the guide plate means exhibits an upward slope in the downstream direction when the guide plate means is in its operative position.

* * * * *